US005336277A

United States Patent [19]

Poirier et al.

[11] Patent Number: 5,336,277

[45] Date of Patent: Aug. 9, 1994

[54] COMPOSITION FOR REDUCING IN-TANK FUEL PUMP COPPER COMMUTATOR WEAR AND METHOD

[75] Inventors: Marc A. Poirier, Sarnia; Robert J. Falkiner, Mississauga, both of Canada

[73] Assignee: Exxon Research & Engineering Co., Florham Park, N.J.

[21] Appl. No.: 966,621

[22] Filed: Oct. 26, 1992

[51] Int. Cl.[5] ..... C10L 1/22; C10L 1/24

[52] U.S. Cl. ..... 44/343; 44/435

[58] Field of Search ..... 44/435, 343

[56] References Cited

U.S. PATENT DOCUMENTS

| | | | |
|---|---|---|---|
| 2,222,122 | 11/1940 | Schulze et al. | 44/435 |
| 2,423,406 | 7/1947 | Scafe et al. | 44/435 |
| 3,014,794 | 12/1961 | Le Roy | 44/435 |
| 3,021,238 | 2/1962 | Mahan | 44/435 |
| 3,663,561 | 5/1972 | Blaha | 260/302 |
| 4,149,966 | 4/1979 | O'Donnell et al. | 208/237 |
| 4,330,302 | 5/1982 | Taylor | 44/435 |
| 5,035,720 | 7/1991 | Weers | 44/343 |

FOREIGN PATENT DOCUMENTS

| | | | |
|---|---|---|---|
| 629543 | 9/1949 | United Kingdom | 44/435 |

*Primary Examiner*—Ellen M. McAvoy

*Attorney, Agent, or Firm*—Richard D. Jordan

[57] ABSTRACT

The resistance of in-tank fuel pump copper commutators to become excessively worn by exposure to petroleum fuels containing at least 10 mg/liter of elemental sulfur is substantially increased by the addition of at least about 5 mg/liter of an organomercaptan, compound and at least about 25 mg/liter of a copper metal deactivator capable of forming a sulfur - resistant barrier coating on the copper commutator, to produce a novel fuel composition.

14 Claims, No Drawings

COMPOSITION FOR REDUCING IN-TANK FUEL PUMP COPPER COMMUTATOR WEAR AND METHOD

BACKGROUND OF THE INVENTION

The present invention relates to the problem of wear of the copper commutators of fuel pumps within fuel tanks associated with the engines, motors, furnaces, etc., powered by fuels such as gasoline.

It has long been realized that elemental sulfur, hydrogen sulfide, mercaptans and other sulfur compounds contained in hydrocarbon fuels, kerosene, jet fuel, heating oil, etc., are corrosive and damaging to metal equipment, particularly copper and copper alloys. The elemental sulfur and sulfur compounds may be present in varying concentrations, as refined, and/or may be incorporated as contaminants picked up during transport of the fuels through pipelines previously used to transport sour hydrocarbon streams such as petroleum crudes which contained high amounts of elemental sulfur, hydrogen sulfide, mercaptans and/or other sulfur compounds.

However, the problems of copper corrosion and in-tank copper commutator wear are distinct and independent problems. In-tank copper commutator wear is a fairly complex mechanism which is not solved by known treatments of fuels to reduce their copper corrosion properties, as commonly determined by the ASTM D-130 copper corrosion test

DISCUSSION OF THE PRIOR ART

It is known to add relatively small amounts of corrosion inhibitor, sulfur scavengers or metal deactivators to fuels which are corrosive to metals, such as copper, in order to pass the ASTM D-130 copper corrosion test.

U.S. Pat. No. 035,720 discloses the addition of a corrosion-inhibiting amount of an oil-soluble adduct of a triazole and a basic nitrogen compound to petroleum-based fuel to reduce the tendency of residual amounts of elemental sulfur and sulfur compounds such as mercaptans present in the fuel to corrode copper and aluminum surfaces in the fuel system. The adduct functions by coating the metal surfaces to provide a barrier against attack by the sulfur and mercaptans, which are disclosed to be corrosive of copper.

On the other hand, Japanese Koho 70-9, 270 teaches the addition of 0.5 to 2 ppm of a mercaptan compound to liquid propane, butane, gasoline or kerosene to reduce the corrosive effects of elemental sulfur present therein relative to copper. Applicants have determined that the addition of the mercaptan compound of this Japanese publication to sulfur-containing fuels does not remove elemental sulfur and does not, per se, provide protection against fuel pump copper commutator wear.

U.S. Pat. No. 663,561 discloses the use of mercaptothiadiazoles as scavengers for elemental sulfur in compositions such as gasoline and fuel oils to react with and deactivate the sulfur against copper corrosion. While copper corrosion is reduced, the sulfur content is not reduced and no protection is afforded against copper commutator wear.

U.S. Pat. No. 4,149,966 discloses the addition of an organo mercaptan compound and a reactive copper compound to refined hydrocarbon fuels to form a soluble complex of the mercaptan, the copper compound and corrosive sulfur present in the hydrocarbon fuels. The treated fuel is contacted with an absorbent material to remove the complex and sulfur from the fuel. No reference is made to the reduction of in-tank fuel pump commutator wear.

Thus, while prior known treatments of fuels were developed to reduce copper corrosion sufficiently to meet the requirements of the ASTM D-130 copper corrosion test, the so-treated fuels do not provide adequate protection against in-tank copper commutator wear and therefore the known fuel treatments do not solve the commutator wear problem.

SUMMARY OF THE INVENTION

The present invention relates to the treatment of hydrocarbon fuels which contain elemental sulfur as a contaminant, and which are exposed to in-tank fuel pump copper commutators, in order to substantially reduce the wear of such copper commutators during exposure to such fuels.

The present invention relates to the discovery that the addition of a predetermined amount of a mercaptan compound, such as propanethiol, to a fuel, such as gasoline, containing elemental sulfur and having dissolved therein a copper metal deactivator, significantly reduces copper commutator wear as compared to a similar sulfur-containing fuel treated with similar amounts of either the copper metal deactivator alone or the mercaptan compound alone.

The fuels suitable for treatment according to the present invention are those fuels used in fuel tanks containing pumps having copper commutators, and include gasoline, diesel fuel, kerosene, jet fuel, heating oil, organic solvents and similar liquid hydrocarbons which contain varying concentrations of elemental sulfur contaminants, either from the refining process or from sulfur-contaminated pipelines through which the fuels have been moved. The fuels which present the greatest problem with respect to copper commutator wear are those which contain at least about 10 mg/liter of elemental sulfur and up to about 60 mg/liter of elemental sulfur.

Many such fuels are currently treated with copper metal deactivators or corrosion inhibitors such as those disclosed in U.S. Pat. No. 5,035,720 discussed above. Thus benzotriazole or tolyltriazole/amine adducts are used, as well as sulfur scavengers as disclosed in U.S. Pat. No. 4,149,966. While such treated fuels may have reduced copper corrosion properties sufficiently that the fuel passes the ASTM D-130 copper corrosion test, such treated fuels nevertheless are found to produce substantial wear of copper commutator strips of fuel pumps present in fuel tanks for the pumping of the fuel to consumption burners or engines.

Applicants have discovered that the resistance of sulfur-containing fuels to cause wear of in-tank fuel pump copper commutators unexpectedly is substantially improved by the addition of predetermined amounts of organomercaptan compounds in combination with predetermined amounts of metal deactivators capable of forming a sulfur-resistant coating on copper commutators.

The addition of organomercaptan compounds to sulfur-containing fuels is unobvious in view of the teachings of the art, such as U.S. Pat. No. 5,035,720, that mercaptan compounds catalyze corrosion of copper in fuel compositions. Moreover, applicants have discovered that organomercaptan compounds are not effective, per se, for substantially reducing copper commutator wear, as measured by a standardized fuel pump rig test. In fact, organomercaptan compounds do not substantially reduce copper corrosion, as measured by the ASTM D-130 test, in the absence of both a metal deactivator, such as disclosed in U.S. Pat. No. 4,149,966, and a sulfur scavenger, as disclosed in U.S. Pat. No. 3,663,561. Organomercaptans are not sulfur scavengers and do not remove elemental sulfur from sulfur-containing fuels. Therefore, the elemental sulfur remains in place to cause the wear of an in-tank copper commutator in the absence of predetermined amount of an organomercaptan additive and a metal deactivating corrosion inhibitor.

DETAILED DESCRIPTION OF THE INVENTION

The novel fuel compositions of the present invention, for reducing the wear of in-tank fuel pump copper commutators, comprise the hydrocarbon fuel containing from about 10 to 60 mg/liter of elemental sulfur, from about 25 to 300 mg/liter, more preferably from about 60 to 150 mg/liter, of at least one copper metal deactivating corrosion inhibitor and from about 5 to 150 mg/liter+, more preferably from about 10 to 60 mg/liter, of at least one organomercaptan compound.

Refined hydrocarbon fuels commonly contain up to about 60 mg/liter of elemental sulfur as an impurity from the refining process and/or from sulfur-contaminated pipelines through which they are transported. Amounts of elemental sulfur above about 10 mg/liter are found to cause excessive wear of an in-tank copper commutator even in the presence of copper corrosion inhibitors and trace amounts of organomercaptan compounds which may be present as contaminants. It should be noted that mercaptans are naturally-occurring materials in trace amounts in most crude fuels and are removed by the refining process, because of their foul odor, and/or are depleted in the pipeline. The final fuel received from the pipeline contains only small trace amounts of mercaptan, generally no more than about two wppm, far less than the minimum amount of 5 ppm required by the present invention. The residual mercaptan content of gasoline batch 926 of Examples 1 and 4 is 1.0 wppm; the residual mercaptan content of gasoline batch 1090 of Example 2 is 0.8 wppm and that of gasoline batch 1446 of Example 3 is 1.7 wppm. The "wppm" content refers to mercaptan sulfur content, with 1 wppm corresponding to 1.5 wppm methyl mercaptan or 2.37 wppm propyl mercaptan.

The copper corrosion inhibitors useful according to the present invention include the known copper metal deactivators which, in the presence of the organomercaptan additive, function by coating the copper commutator strip to prevent the elemental sulfur from contacting and corroding the copper commutator and contributing to the wear thereof. Suitable corrosion inhibitors include the commercially-available compositions which form a sulfur-resistant protective barrier over copper metal surfaces, preferably aromatic and non-aromatic triazole compounds, most preferably the triazole/amine adducts of U.S. Pat. No. 5,035,720.

The essential organo-mercaptan compounds of the present invention include a wide variety of compounds having the general formula RSH, where R represents an organic radical which may be alkyl, alkenyl, cycloalkyl, cycloalkenyl, aryl or arylalkyl having from i to about 16 carbon atoms. Thus the radical may be, for example methyl, ethyl, n-propyl, i-propyl, n-butyl, i-butyl, sec-butyl, t-butyl, amyl, n-octyl, decyl, dodecyl, octadecyl, phenyl, benzyl and the like. Most preferably, R is an alkyl radical containing 2–5 carbon atoms.

Commercially available mixtures of the above with other related compounds such as dimethylsulphide (DMS) or tetrahydrothiophene, which are used as for LPG and natural gas, are convenient sources of reactive mercaptans. The disclosed mercaptan would generally be added at the terminal but it can also be added at the refinery (pre-pipeline).

The fuels which are treated in accordance with the invention include fuels containing elemental sulphur in amounts which are detrimental to the wear of copper commutators. The invention is particularly applicable to those liquid products which have became contaminated with elemental sulphur as a result of being transported in a pipeline previously used to transport sour hydrocarbon streams such as petroleum crudes.

The following examples illustrate the critical differences between providing sulfur-containing fuels with copper corrosion-resistance, as measured by ASTM D-130, and providing sulfur-containing fuels with copper commutator wear-resistance, as measured by the following standardized fuel pump rig test:

FUEL PUMP RIG TEST

A GM electrical fuel pump Model No. 25116162 is clamped to a 2 foot metal rod, fitted through a rubber cork No. 12½. Special Teflon-coated wires (gasoline resistant) are soldered to the fuel pump and connected to a power supply able to deliver 12 volts and 4.5 amp. The fuel pump is immersed in 20 liters of test fuel contained in a 23 liter epoxy-lined metal pail. A small hole through the rubber cork overcomes pressure buildup. The fuel pump is run for 360 hours at controlled fuel temperature (+40° C.). After that period, the fuel pump is cut open and the copper commutator measured for wear.

In comparative Example 1, similar fuel compositions 1, 2 and 3 were produced according to the present invention and were tested for copper corrosion according to the ASTM D-130 test and for copper commutator wear according to the above-described standardized fuel pump rig test. Batch 926 is a gasoline containing about 33mg/liter elemental sulfur and 1.0 wppm residual mercaptan sulfur content. T 9702 is an oil-soluble copper-deactivating, metal-coating corrosion inhibitor comprising an aromatic triazole/amine adduct according to U.S. Pat. No. 5,035,720. Elco 461 is a sulfur scavenger comprising 2-hydrocarbyl-5-mercapto-1, 3, 4-thiadiazole according to U.S. Pat. No. 3,663,561.

EXAMPLE 1

| | Copper Corrosion D-130 | |
|---|---|---|
| | Elco 461 mg/l | |
| | 0 | 4 |
| Sample 1 | | |
| Batch 926 (liter) | | |
| T 9702 - 80 mg/l | 3d (wear 0.015") | 1a |
| Propyl Mercaptan - 10 mg/l | | |
| Sample 2 | | |
| Batch 926 (liter) | | |
| T 9702 - 80 mg/l | 3d (wear 0.012") | 1a |
| Propyl Mercaptan - 30 mg/l | | |
| Sample 3 | | |
| Batch 926 (liter) | | |
| T 9702 - 90 mg/l | 3d (wear 0.005") | 1a |

-continued

| | Copper Corrosion D-130 | |
|---|---|---|
| | Elco 461 mg/l | |
| | 0 | 4 |
| Propyl Mercaptan - 50 mg/l | | |

The foregoing tests illustrate that the present composition of samples, 1, 2 and 3 provide poor resistance to copper corrosion, as indicated by the readings of 3d in the ASTM D-130 test, and that it is necessary to add 4 mg/l of Elco 461, a sulfur scavenger, in order to provide acceptable D-130 test readings of 1a for each of the samples.

However all three samples, without the addition of any sulfur scavenger, provide substantially improved resistance to copper commutator wear, particularly with increasing mercaptan content, as illustrated by the wear values as set forth.

The following Examples 2, 3 and 4 illustrate compositions according to the present invention, compared to similar compositions devoid of the organomercaptan compound, with respect to in-tank fuel pump commutator wear. Example 5 is a comparative example illustrating high commutator wear in the absence of the T 9702 metal deactivator.

EXAMPLE 2

| | Parts by Volume | |
|---|---|---|
| Composition | A | B |
| Gasoline 1090 | liter | liter |
| T9702 | 80 mg | 80 mg |
| Propanethiol | 0 | 150 mg |
| Elemental sulfur | 31 mg | 31 mg |
| Copper commutator wear | 0.02" | 0.004" |

EXAMPLE 3

| | Parts by Volume | |
|---|---|---|
| Composition | A | B |
| Gasoline 1446 | liter | liter |
| T9702 | 190 mg | 190 mg |
| Propanethiol | 0 | 20 mg |
| Elemental sulfur | 20 mg | 20 mg |
| Copper commutator wear | 0.008" | 0.003" |

EXAMPLE 4

| | Parts by Volume | |
|---|---|---|
| Composition | A | B |
| Gasoline 926 | liter | liter |
| T9702 | 80 mg | 80 mg |
| Propanethiol | 10 mg | 50 mg |
| Elemental sulfur | 10 mg | 10 mg |
| Copper commutator wear | 0.005" | 0.002" |

EXAMPLE 5

| | Parts by Volume | |
|---|---|---|
| Composition | A | B |
| Gasoline 926 | liter | liter |
| T-9702 | 0 | 0 |
| Propanethiol | 0 | 30 mg |

-continued

| | Parts by Volume | |
|---|---|---|
| Composition | A | B |
| Elemental sulfur | 33 mg | 33 mg |
| Copper Commutator wear | 0.02" | 0.02" |

The foregoing examples illustrate the unexpected improvement in reduced copper commutator wear, as measured by the standardized fuel pump rig test, resulting from the incorporation of propanethiol. After the measurement of the commutator wear, analyses of the present compositions showed the presence of disulphides and trisulphides formed during the wear reduction process. While the prior art suggests that such sulfur compounds, including di-n-propyl-disulphide and -trisulphide, are corrosive to copper, applicants have found that such materials provide D-130 copper corrosion values of 1a.

The foregoing examples illustrate that the addition of mercaptan to the metal deactivator gives improved performance relative to the metal deactivator alone. Example 3A shows better performance than Samples 1 and 2 of Example 1 because 3A contains much more additive (190 mg. vs. 80 mg. and 80 mg.). Sample 3 of Example 1 contains less additive (90 mg. vs. 190 mg.) than Example 3A, but it has less wear because Sample 3 contains mercaptan whereas Example 3A does not. Also, a small amount of mercaptan in Example 3B gave a significant improvement.

It is to be understood that the above described embodiments of the invention are illustrative only and that modifications throughout may occur to those skilled in the art. Accordingly, this invention is not to be regarded as limited to the embodiments disclosed herein but is to be limited as defined by the appended claims.

What is claimed is:

1. A refined petroleum fuel composition comprising at least about 10 mg/liter of elemental sulfur and having increased resistance to causing copper commutator wear in fuel pumps through which the composition is pumped, said composition having added thereto at least about 25 mg/liter of an oil soluble triazole-amine adduct, and at least about 5 mg/liter of at least one organomercaptan compound which, in combination with said metal deactivator, increases the resistance of the fuel composition to cause a copper commutator wear during use.

2. A fuel composition according to claim 1 in which said oil-soluble triazole-amine adduct is present in an amount within the range of from about 25 to about 300 mg/liter.

3. A fuel composition according to claim 2 in which said oil soluble triazole-amine adduct is present in an amount within the range of from about 60 to about 150 mg/liter.

4. A fuel composition according to claim 1 in which said organomercaptan compound comprises an alkyl mercaptan compound containing from 2 to 5 carbon atoms.

5. A fuel composition according to claim 1 in which said organomercaptan compound is added in an amount within the range of from about 5 to about 100 mg/liter.

6. A fuel composition according to claim 5 in which said organomercaptan compound is added in an amount within the range of from about 10 to about 60 mg/liter.

7. A fuel composition according to claim 1 in which said fuel is gasoline which has been transported in a pipeline, thereby acquiring said content of elemental sulfur.

8. A method for reducing copper commutator wear in fuel pumps through which a refined petroleum fuel containing at least 10 mg/liter of elemental sulfur is pumped, comprising adding an oil soluble triazole-amine adduct and at least one organomercaptan to said sulfur-containing fuel, wherein the oil soluble triazole-amine adduct is added to a concentration of at least about 25 mg/liter, and the organomercaptan is added to a concentration of at least about 5 mg/liter.

9. A method according to claim 8 which comprises adding said oil-soluble triazole-amine adduct in an amount within the range of from about 25 to about 300 mg/liter.

10. A method according to claim 9 which comprises adding said oil soluble triazole-amine adduct in an amount within the range of from about 60 to about 150 mg/liter.

11. A method according to claim 8 in which said organomercaptan compound comprises an alkyl mercaptan compound containing from 2 to 5 carbon atoms.

12. A method according to claim 8 which comprises adding said organomercaptan compound in an amount within the range of from about 5 to about 100 mg/liter.

13. A method according to claim 12 which comprises adding said organomercaptan compound in an amount within the range of from about 10 to about 60 mg/liter.

14. A method according to claim 8 in which said fuel is gasoline which has been transported in a pipeline, thereby acquiring said content of elemental sulfur.

* * * * *